United States Patent [19]

Crawford

[11] Patent Number: 4,890,367

[45] Date of Patent: Jan. 2, 1990

[54] CREMATORY LOADER

[76] Inventor: James P. Crawford, P.O. Box 13243, Orlando, Fla. 32859

[21] Appl. No.: 348,870

[22] Filed: May 8, 1989

[51] Int. Cl.[4] ..... A63G 17/00

[52] U.S. Cl. ..... 27/27; 27/26; 414/282; 414/522

[58] Field of Search ..... 27/26–28; 414/281, 282, 522, 529, 749, 921; 280/640; 5/81 B, 811 R

[56] References Cited

U.S. PATENT DOCUMENTS

| | | | |
|---|---|---|---|
| 714,663 | 12/1902 | Brannock | 27/26 |
| 1,550,127 | 8/1925 | Tschumperlin | 27/26 |
| 1,801,914 | 4/1931 | Gibbons | 27/26 |
| 1,928,217 | 9/1933 | Bruning | 27/26 |
| 2,817,138 | 12/1957 | Merz | 27/26 |
| 3,402,836 | 9/1968 | Debrey et al. | 414/282 X |
| 4,644,594 | 2/1987 | Johnson | 5/81 R |

*Primary Examiner*—Richard E. Chilcot, Jr.
*Attorney, Agent, or Firm*—William M. Hobby, III

[57] ABSTRACT

A crematory loader apparatus is provided for loading objects to be incinerated into a preheated crematory. The loader has a frame along with a slidable support surface attached to the frame for supporting an object thereon which slides in a track supporting the slidable top surface during sliding of the top surface between a first position for loading the object onto the slidable support surface and a second position canterlevering the slidable support surface into the crematory. A plurality of legs are attached to the frame and support the frame and the slidable support surface. A stop member is movably attached to the frame and has a first position out of the path of an object on the slidable support surface and a second position blocking the path of the object on the slidable support surface to block the movement of the object when the slidable top surface is moved from the second position to the first position to thereby force the object into the crematory as the slidable support surface is withdrawn from its second canterlevered position. The slidable support surface has rollers thereon with a ramp at one end with a roller thereon to slide an object off the slidable support surface. The support surface is moved by an electric motor driven chain drive.

15 Claims, 2 Drawing Sheets

CREMATORY LOADER

BACKGROUND OF THE INVENTION

The present invention relates to a crematory loading system and especially to a crematory loader which can rapidly position an object in a preheated crematory.

In the past a number of types of crematories have been provided including those for cremating human remains as well as crematories specially made for cremating animal remains or for incinerating waste such as hospital waste. In a typical crematory, crematory ovens are lined with a ceramic kiln brick and has at least a main chamber in which the object to be cremated is inserted. Typically gas burners preheat the crematory which is kept in operation until all the objects being cremated have been completed. This however, leaves a very hot oven making it most difficult to slide large objects into the oven in a safe manner. The present invention is directed towards a crematory loader system which allows an object to be rapidly positioned in a crematory by a single individual in a safe manner.

There have been a number of suggestions for various types of crematories and various types of devices for handling caskets and the like. Typical devices for handling caskets can be seen in a Jamison U.S. Pat. No.: 2,135,898 which is used to position a casket and has a stop at one end. The Merz Patent No.: 2,817,138 also shows a casket placer, while the Connally Patent No.: 2,601,714 has a casket table with rollers built thereinto. The Sullins Patent No.: 2,273,501 is for a casket truck mounted on rollers for positioning a casket, while the Bruning U.S. Pat. No.: 1,928,217 is for a portable supporting rack for caskets. The Albrecht Patent No.: 1,242,410 transfers caskets on rollers from a supporting base, while the Siebert U.S. Pat. No.: 1,936,275 shows another device for handling caskets.

In contrast to these prior devices the present invention is specifically directed towards a crematory loader which provides for pushing the container into a heated crematory on a suspended canterlever roller table using a motor operated chain drive to move the platform with the container thereon into the crematory. A blocking arm is then swung into the path of the container on the crematory suspended roller platform behind the container so that withdrawing the suspended roller platform with the motor drive will prevent the container from returning and thereby drive the container into the crematory.

SUMMARY OF THE INVENTION

The present invention relates to a loader for crematories and incinerators which includes a frame which can be positioned in front of a crematory loading door. The frame has a slidable support surface attached thereto for supporting an object to be cremated thereon. The sliding support surface is supported in roller tracks which allows it to slide between a first position for loading an object thereon and a second suspended position counterlevering the slidable support surface into the crematory oven. The sliding support surface may also have a small ramp at one end and rollers along the surface for rolling on object thereon. A plurality of legs support the frame and slidable support surface thereon. A stop arm is movably attached to the frame and has a first position out of the path of an object on the sliding top surface and a second position having a portion directly over the sliding support surface so that an object can be positioned on the sliding surface in its first position and moved into the crematory as the sliding support surface is canterlevered thereinto. The stop arm is positioned in the path of the object over the sliding support surface and the sliding support surface retracted so that the stop arm blocks the return of the object allowing it to drop onto the surface of the crematory oven. The stop arm is a swinging arm which allows a protruding portion to swing up on top of the support surface. The extending portion of the arm may have rollers to support the arm on the slidable support surface which rolls thereon as the slidable support surface is drawn from the second to the first position. An electric motor operated chain drive moves the support surface between its first and second positions and has limit switches to stop the movement in either direction. In addition, the plurality of legs may have wheels mounted thereon for riding in a track for shifting the crematory loader from a position for loading an object thereon to a position directly in front of the opening to the crematory.

BRIEF DESCRIPTION OF THE DRAWINGS

Other objects, features and advantages of the present invention will be apparent from the written description and the drawings in which:

FIG. 2-B is a partial sectional view illustrating the rotation of the arm in FIG. 2-A;

FIG. 4-B is a top plan view of a crematory loader of FIG. 4-A with the object being moved into the crematory;

FIG. 4-C is a top plan view in accordance with FIGS. 4-A and 4-B in which the blocking arm is positioned to hold the object in the crematory;

FIG. 4-E is a top plan view in accordance with FIGS. 4-A through 4-C with the table returning and the object being blocked in the crematory;

FIG. 4-E is a top plan view of a crematory loader in accordance with FIGS. 4-A through 4-D having the support platform partially returned; and FIG. 4-F is a top plan view of a crematory loader in accordance with FIGS. 4-A and 4-E having the object to be cremated loaded in the crematory.

DESCRIPTION OF THE PREFERRED EMBODIMENT

Figure 1:
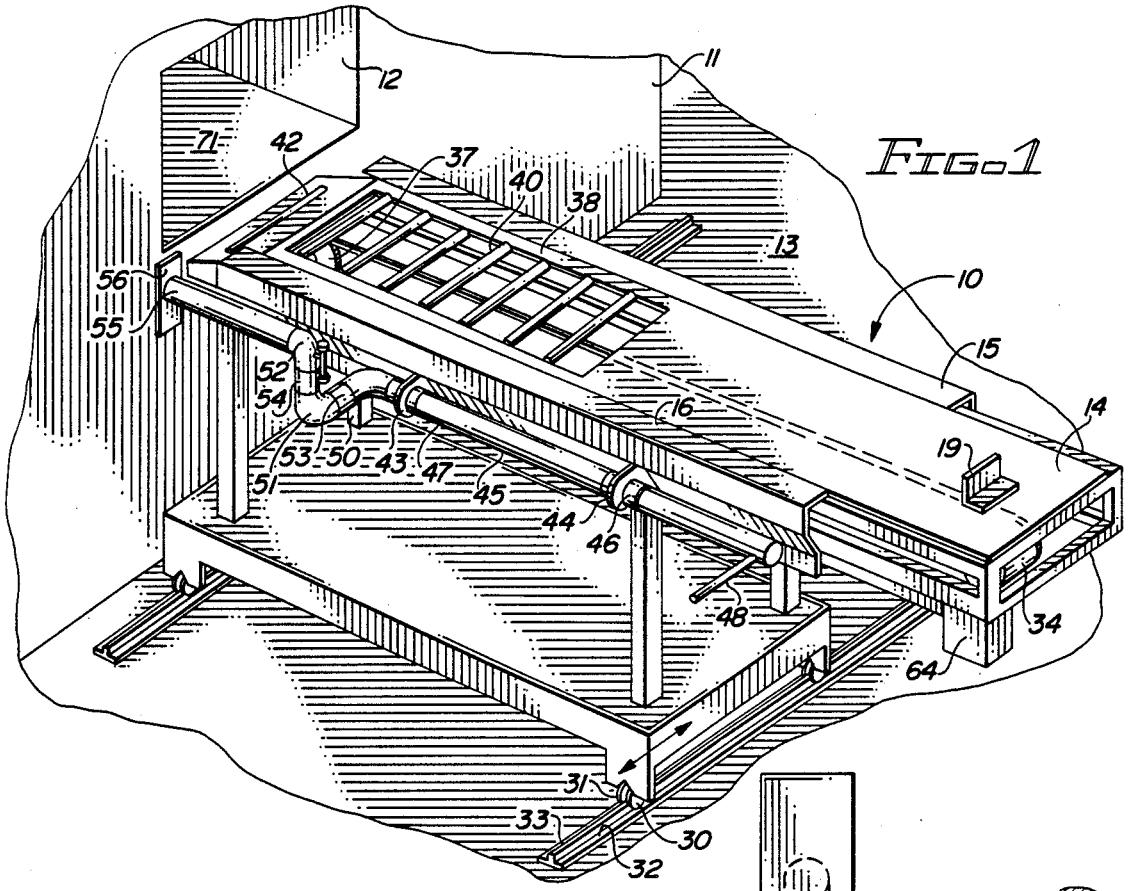
FIG. 1 is a perspective view of a crematory loader in accordance with the present invention lined up in front of a crematory.
Figure 2A:
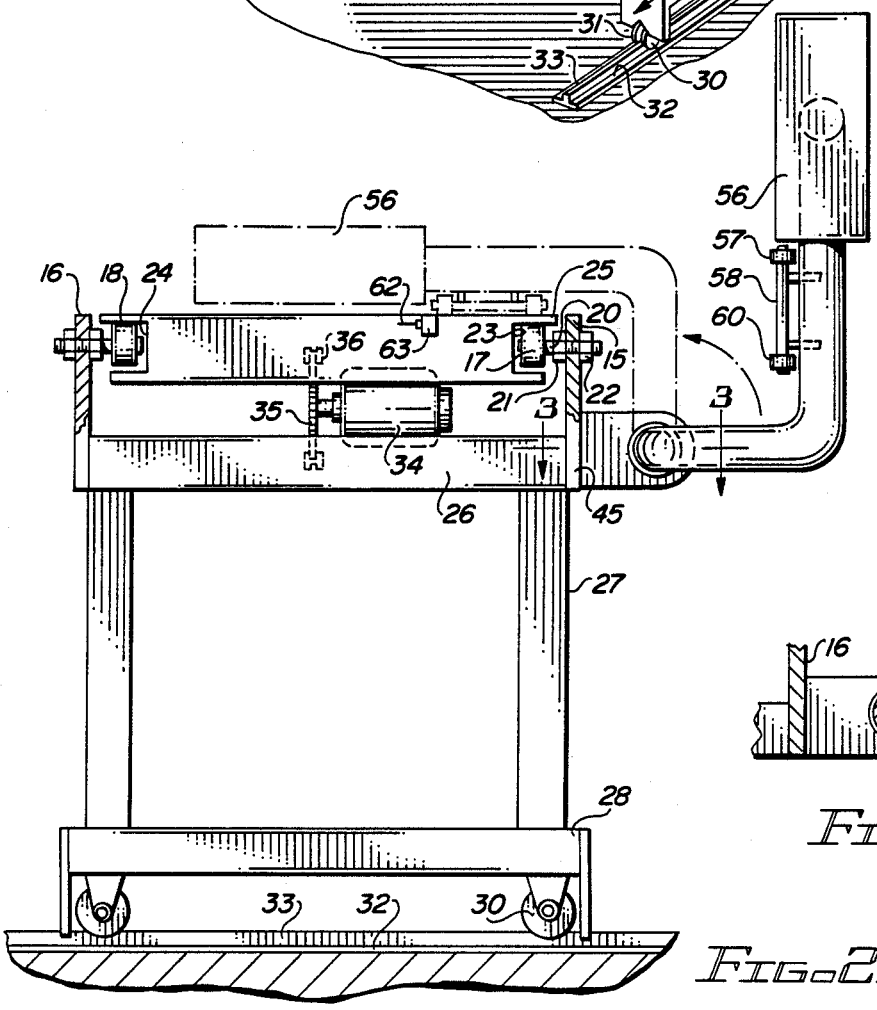
FIG. 2-A is an end elevation of a crematory loader in accordance with FIG. 1.
Figure 3:
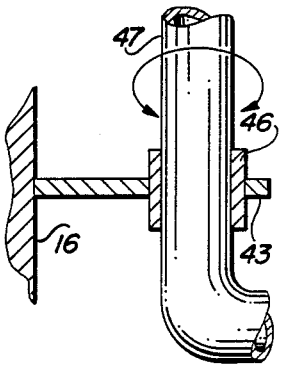
FIG. 3 is a sectional view taken on line 3—3 of FIG. 2-A.
Figure 2B:
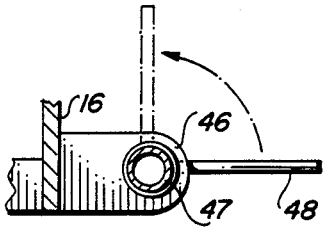

Referring to the drawings and especially to FIGS. 1 through 3, a crematory loader 10 is shown in FIG. 1 in front of a crematory 11 having a crematory opening 12 sitting on a floor 13. The crematory loader 10 has a sliding platform or support surface 14 sliding in a pair of roller frame members 15 and 16. Frame member 15 has a plurality of rollers 17 mounted thereto while the frame member 16 has a plurality of rollers 18 mounted thereto. The rollers 17 and 18 are generally ball bearing rollers mounted to a shaft 20 held with nuts 21 and 22 to the frame members 15 and 16. The slidable support table 14 has elongated groove areas or tracks 23 on one side and track 24 on the other side for maintaining the rollers 17 and 18 therein with each having a top support surface 25 so that the table 14 rides on the rollers 17 and 18 as it slides back and forth. The track members 15 and 16 are supported to an additional framework 26 which has a plurality of legs 27 extending therefrom to a base 28. Base 28 in turn has a plurality of wheels 30 mounted thereto which have annular grooves 31 therein for rolling on the tracks 32 on the floor 13. The tracks 32 have elongated ribs 33 for the grooves 31 of the wheels 30 to roll in.

As seen in FIG. 2-A, an electric motor 34 is mounted to the back portion and drives a sprocket 35 and a chain 36. The chain 36 is connected to a gear sprocket 37 at the opposite end of the platform 14 and is connected to the platform 14 to move the platform forwards and backwards responsive to the motor being driven in a forward or reverse direction. The platform 14 has one or more cutout areas 38 therein with a plurality of elongated rollers 40 mounted thereacross to allow an object placed on the platform 14 to be slid thereoff along a front ramp 41 also having a single elongated roller 42 mounted therein. The elongated rollers 40 and 41 protrude slightly above the surface of the platform 14 and the ramp 41. A pair of journal brackets 43 and 44 are welded to the side of the frame 45 and each has a sleeve 46 therein for a cylindrical pipe or rod 47 to ride in, thus the cylindrical pipe or rod 47 can rotate in the journal brackets 43 and 44 by the turning of a handle 48 attached to one end of the shaft 47. The shaft 47 has an elbow 50 adjacent to bracket 43 and a second elbow 51 and a third elbow 52. A short extension member 53 is positioned between the elbows 50 and 51 and a short extension 54 is positioned between the elbows 51 and 52 and a protruding blocking arm 55 extends from the elbow 52. The blocking arm 55 has a blocking plate 56 attached to the end thereof. The short extension 54 has a pair of rollers 57 attached thereto and rides on a shaft 58 held by bolts 60. Thus rotating the handle 48 will rotate the shaft 47 in the journals 44 and 43 to rotate the wheels 57 onto the platform 14 when the platform is extended with the rollers 40 extending into the oven to position the blocking plate 56 directly in the middle of the path of an object being moved on the platform 14 as it slides into the oven 12 while being returned therefrom.

In operation an object may be loaded on the platform 14 and the crematory loader 10 rolled on the wheels 31 on the tracks 32 to a position directly in front of a crematory 11 opening 12. The motor 34 is actuated to drive the platform 14 to move the object sitting on the rollers 40 on the platform 14 into the crematory opening 12 to canterlever the platform 14 thereinto. The person may then grab the handle 48, rotate it to allow the wheels 57 to ride on the back of the platform 14 positioning the blocking plate 56 in the path of the object directly behind the object sitting on the rollers 40. The motor 34 can then be driven in a reverse direction to return the platform 14 while the fixed blocking plate 56 blocks the object and forces it to roll on the rollers 40 down the ramp 41 on the roller 42 into the crematory 11. After the platform has been reversed a predetermined distance the handle 43 may be grasped and rotated in the opposite direction to shift the blocking plate 56 out of the way as shown in FIG. 1.

Figures 4A, 4B, 4C, 4D, 4E, 4F:
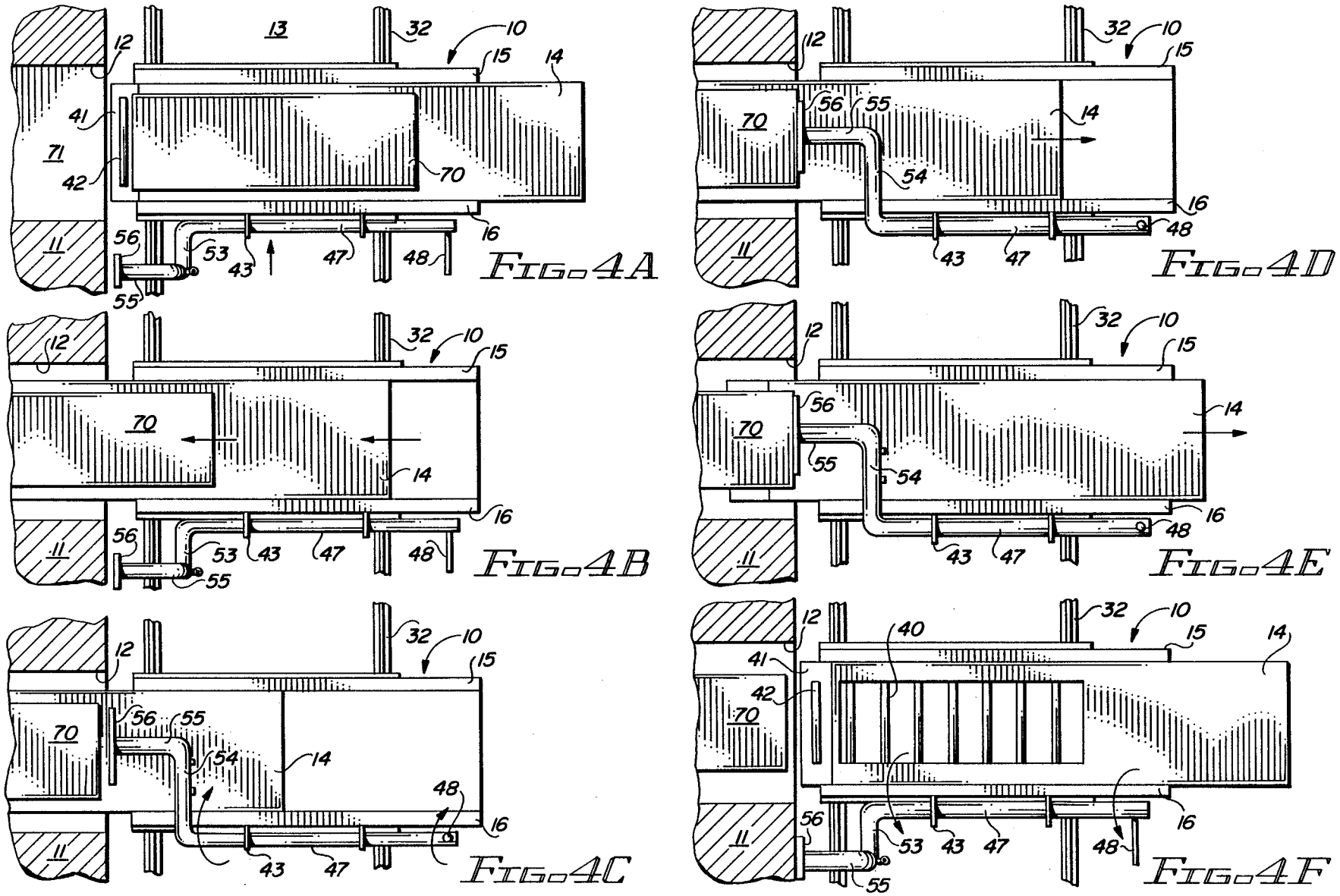
FIG. 4-A is a top plan view of a crematory loader of FIG. 1 with an object to be cremated placed thereon.

The operation is more clearly shown in connection with FIGS. 4-A through 4-F which each show a top plan view of a crematory loader in accordance with the present invention in different loading positions. In FIG. 4-A the crematory loader 10 has been rolled into position on the tracks 32 in front of the crematory 11 opening 12. The tracks 32 are on the floor 13 and an object 70 to be incinerated has been placed on the platform 14. The blocking mechanism 47 mounted in the journal brackets 43 and 44 has a handle 48 thereon along with the blocking plate 56 on the front riding on the extending arm 55. The ramp 41 with a roller 42 is also illustrated and the rollers 40 are shown in FIG. 4-F. In FIG. 4-B the electric motor has been actuated in a forward direction to move the platform 14 with the object 70 thereon partially into the crematory 11 and in FIG. 4-C the platform is fully canterlevered into the crematory and the blocking plate 56 has been aligned behind the object 70 by grabbing the handle 48 and rotating the shaft 37. The electric motor is then reversed as in 4-D to start the return of the platform 14 from the crematory 11 which draws the object 70 against the blocking plate 56 and forces it to slide on the rollers 40 until it tilts onto the ramp 41 and onto the roller 42 and onto the floor 71 of the crematory 11. In FIG. 4-E the platform 14 has been more fully retracted from the crematory and the object 70 has been tilted onto the floor 71 of the crematory 11. In FIG. 4-F the platform is fully withdrawn, the object 70 is placed in the crematory 11 oven 12 and the blocking arm 47 has been swung back to its resting position with the plate 56 out of the way of the top of the platform 14. The crematory loader 10 can then be rolled on the tracks 32 to a position for reloading the platform 14 with another object 70 and rolled back into place in front of the crematory 11 or in front of another crematory for loading the crematory.

It should be clear at this time that a crematory loader and a method of loading a crematory have been illustrated which makes the loading of a heated oven safe. However other features are also contemplating such as, a trip bar 61 shown in FIG. 2 attached to the bottom of the platform 14 for tripping a feeler 62 of a microswitch 63 to stop the operation of the electric motor 34 in a forward or reverse direction when the platform 14 reaches its limit in a forward or reverse direction. This is in addition to the manual switch 64 for actuating the electric motor. Accordingly, the present invention is not to be limited to the form shown which is to be considered illustrative rather than restrictive.

I claim:

1. A crematory loader comprising:

a frame;

slidable support means attached to said frame for supporting an object thereon, said slidable support means having a slidable top surface and a track for supporting said slidable top surface during sliding of said top surface between first and second positions whereby an object placed thereon may be moved from a first to a second position;

at least one leg attached to said frame supporting said frame; and stop means movably attached to said frame, said stop means having a first position out of the path of an object on said sliding top surface and a second position blocking the path of an object for blocking the movement of an object supported on said slidable support means when said slidable top surface is moved from said second to said first position thereby pushing said object off one end of said slidable top surface.

2. A crematory loader in accordance with claim 1 in which said slidable support means slidable top surface has a plurality of elongated rollers mounted thereon in at least one opening in said slidable top surface and protruding therefrom to thereby allow an object to roll thereover.

3. A crematory loader in accordance with claim 2 in which said slidable support means slidable top surface has a ramp surface mounted on one end thereof.

4. A crematory loader in accordance with claim 3 in which said slidable support means slidable top surface ramp surface has an elongated roller mounted in a slotted opening therein and protruding thereabove whereby an object rolled on said slidable top surface rollers can be rolled over said ramp roller.

5. A crematory loader in accordance with claim 4 in which said slidable support means includes an electric motor mounted to said frame for driving said slidable top surface.

6. A crematory loader in accordance with claim 5 in which said electric motor is a reversible electric motor driving a change drive to move said slidable top surface into and out of an crematory.

7. A crematory loader in accordance with claim 6 in which a limit microswitch is connected to limit the movement of said slidable top surface by switching off said electric motor.

8. A crematory loader in accordance with claim 7 in which said frame has a plurality of rollers mounted on two sides thereof for slidably supporting said slidable top surface thereto.

9. A crematory loader in accordance with claim 8 in which said slidable top surface has a grooved track formed on opposite sides thereof and having said plurality of rollers mounted on said frame riding therein to support said slidable top surface.

10. A crematory loader in accordance with claim 9 in which said frame rides on a plurality of wheels on a surface mounted track for aligning said crematory loader in position in front of a crematory to be loaded.

11. A crematory loader in accordance with claim 10 in which said plurality of wheels each have an annular groove therein riding on an elongated ridge formed on said track.

12. A crematory loader in accordance with claim 11 in which said stop means includes a pair of brackets mounted on the side of said frame and having an elongated rotatable member mounted thereto and said elongated rotatable member having a stop member on one end thereof adapted to be swung over to a position over said slidable top surface.

13. A crematory loader in accordance with claim 12 in which said stop means stop member includes a flat plate connected to the end of a compound curved portion of the end of said elongated rotatable member whereby rotating said elongated rotatable member positions said flat plate in the path of an object on said slidable top surface.

14. A crematory loader in accordance with claim 13 in which said stop means stop member at least one wheel thereon for riding on said slidable top surface.

15. A crematory loader in accordance with claim 14 in which said stop means elongated rotatable member has a handle thereon for turning said elongated rotatable member.

* * * * *